United States Patent [19]

Ambasz

[11] Patent Number: 4,953,673

[45] Date of Patent: Sep. 4, 1990

[54] EXPANDABLE LUGGAGE

[76] Inventor: Emilio Ambasz, 295 Central Park West, New York, N.Y. 10024

[21] Appl. No.: 381,458

[22] Filed: Jul. 17, 1989

[51] Int. Cl.[5] ..... A45C 7/00; A45C 13/04; A45C 13/36

[52] U.S. Cl. ..... 190/103; 190/107; 190/127; 383/2

[58] Field of Search ..... 190/103, 107, 21, 127; 229/117.01, 117.04; 383/2

[56] References Cited

U.S. PATENT DOCUMENTS

| | | | |
|---|---|---|---|
| 249,092 | 11/1881 | Protzen | 190/103 |
| 1,045,390 | 11/1912 | Goldsmith | 190/103 |
| 1,513,909 | 11/1924 | Hunter | 190/103 |
| 1,573,721 | 2/1926 | Loeffler | 190/107 |
| 1,636,838 | 7/1927 | Roser | 190/103 |
| 1,712,448 | 5/1929 | Eckhardt | 190/103 |
| 2,425,035 | 8/1947 | Garnett et al. | 190/107 |
| 2,710,084 | 6/1955 | Brauerman | 190/107 |
| 4,356,899 | 11/1982 | Tawil | 190/103 |
| 4,588,056 | 5/1986 | Bernbaum | 190/107 |

FOREIGN PATENT DOCUMENTS

| | | | |
|---|---|---|---|
| 20989 | 2/1883 | Fed. Rep. of Germany | 190/103 |
| 725576 | 5/1932 | France | 190/103 |
| 18192 | of 1892 | United Kingdom | 190/103 |
| 4809 | of 1914 | United Kingdom | 190/103 |
| 261923 | 12/1926 | United Kingdom | 190/103 |

*Primary Examiner*—Sue A. Weaver

*Attorney, Agent, or Firm*—Brumbaugh, Graves, Donohue & Raymond

[57] ABSTRACT

An item of expandable luggage comprises rigid top, bottom and intermediate frames, top and bottom wall members and peripheral wall assemblies composed of pleated, expandable/contractable outer wall members affixed to the frames and foldable rigid inner wall members affixed to the top frame. Releasable fasteners associated with the rigid, foldable inner wall members and the bottom frame member retain the luggage item selectively in the expanded and collapsed conditions.

4 Claims, 3 Drawing Sheets

EXPANDABLE LUGGAGE

BACKGROUND OF THE INVENTION

It is a nuisance to carry around a large, half-empty briefcase, overnight case, piece of luggage, sample case, tool case, or the like. It is also a nuisance to find that an item of luggage (the term "luggage" is used herein to refer to all manner of transportable carrying cases) at hand is not large enough for the articles one desires to place in it. Various forms of expandable luggage have been proposed, but few are commercially available.

The most common forms of expandable luggage are briefcases and purses having pleated, accordian-like side walls that expand and contract, depending on how much they are filled. While such items have the advantage of adjusting their size to varying volumes of material, they have the disadvantage of having pliable walls, which do not provide very much protection for the articles carried in the item. Pleated briefcases are somewhat inconvenient to use, particularly when they are filled to near capacity, in that leafing through the contents to find something is difficult at best.

SUMMARY OF THE INVENTION

There is provided, in accordance with the invention an item of expandable luggage comprising a rigid top peripheral frame, a rigid bottom peripheral frame, and a rigid intermediate peripheral frame. A rigid top wall panel member is affixed to the top frame, and a rigid bottom wall panel member is affixed to the bottom frame. An upper peripheral wall member of a pleated sheet material is affixed to the top and intermediate frames, and a lower peripheral wall member of pleated sheet material is affixed to the bottom and intermediate frames. The pleats of the peripheral wall members extend peripherally so that the peripheral wall members can be selectively expanded and collapsed to define a larger volume and a smaller volume of the luggage item. Foldable rigid side and end wall members affixed to the top frame, located within the pleated peripheral wall members, and having first and second portions foldable along fold lines parallel to the top and bottom frames, define when unfolded the larger volume and when folded the smaller volume.

Preferably, releasable fasteners are associated with the foldable wall members to retain the item of luggage selectively in the smaller volume and larger volume configurations. The fasteners may be snap fasteners having a first element and two second elements engageable with the first elements. The first element is affixed to the bottom frame member, one second element is affixed to a first portion of a foldable wall member and the other second element is affixed to a second portion of said foldable wall member.

The rigid, foldable peripheral walls provide, selectively, structurally rigid, defined smaller and larger volumes and provide protection for the contents from impacts to the pleated external peripheral wall members and load-carrying capability for the contents of the luggage item. In preferred embodiments, the top wall is hinged, so that the luggage item is convenient to fill and empty and the contents are readily accessible, which makes it easy to search for specific articles. Luggage according to the invention can be made in larger sizes than expandable luggage without rigid internal walls, inasmuch as the internal rigid foldable walls mechanically support the contents, whereas pleated, pliable walls have limited load-carrying capability.

For a better understanding of the invention, reference may be made to the following description of an exemplary embodiment, taken in conjunction with the accompanying drawings.

DESCRIPTION OF THE EMBODIMENT

Figure 1:
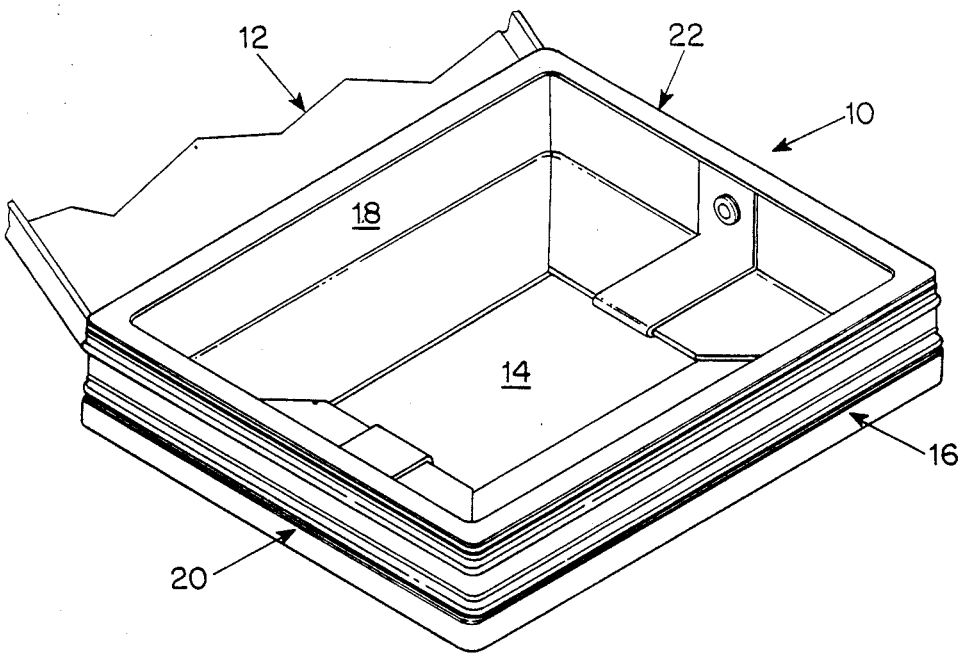
FIGS. 1 and 2 are pictorial views of the embodiment in the collapsed and expanded conditions, respectively, a portion of the lid being broken away.
Figure 2:
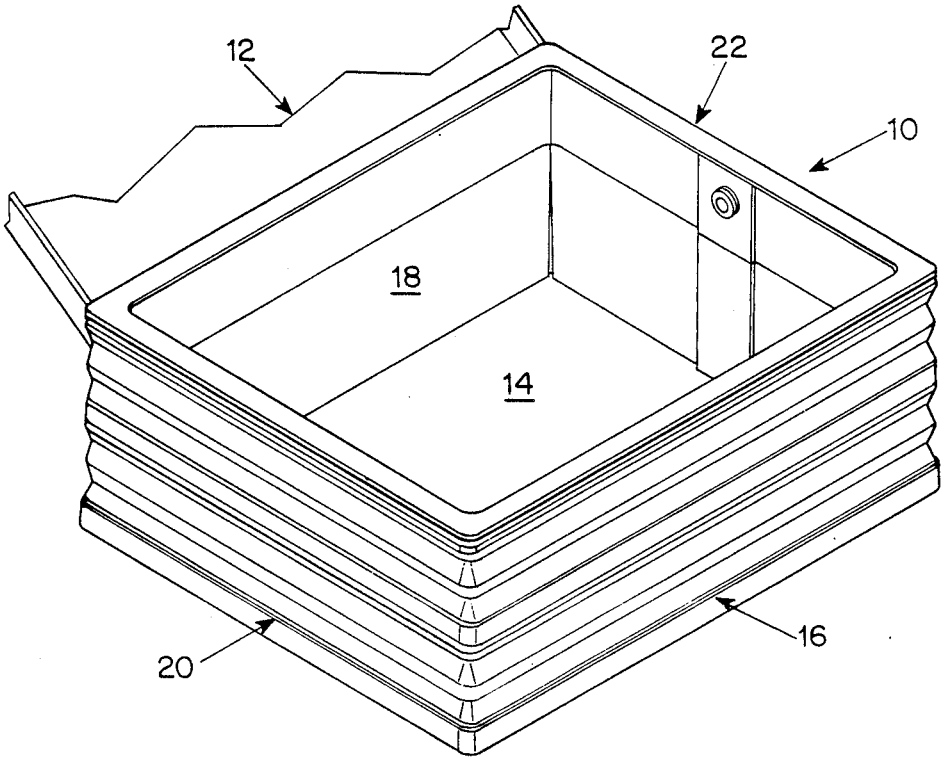

Referring first to FIGS. 1 and 2, the embodiment comprises a rectangular box-like body 10 and a rectangular top wall or lid 12 joined by hinges (not shown) to the upper edge of one of the longer perimeter walls. The body comprises a rigid bottom wall 14 and a perimeter wall consisting of portions that, for convenience, are referred to herein as a front wall 16, a rear wall 18, a left end wall 20 and a right end wall 22. As described in greater detail below, the perimeter walls 16, 18, 20 and 22 comprise external pleated wall members, the pleats of which extend parallel to the top and bottom so that the pleated members are expandable and contractable, and rigid internal foldable members that fold along articulating junctures parallel to the top and bottom walls. When the rigid wall members are folded at right angles, the body 10 defines a lesser internal volume (FIG. 1), and when they are extended, the body 10 defines a greater internal volume (FIG. 2).

Figure 5:
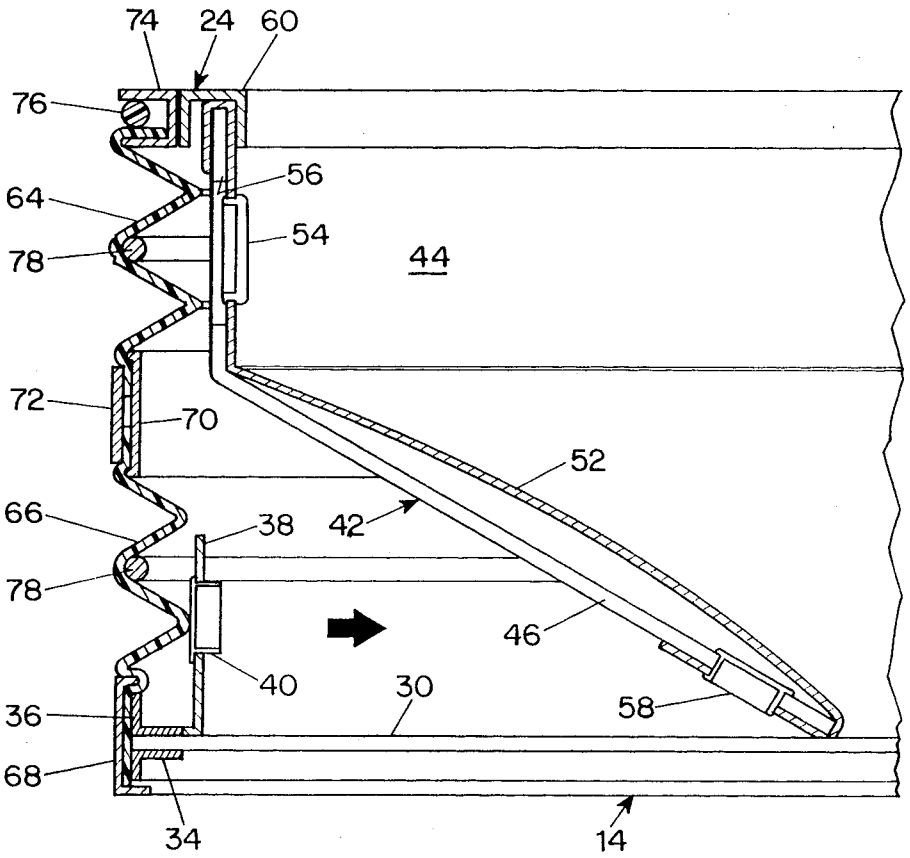
FIGS. 4 and 5 are partial cross-sectional views taken along the lengthwise center plane, the luggage item being shown in the expanded and partially expanded conditions, respectively.
Figure 4:
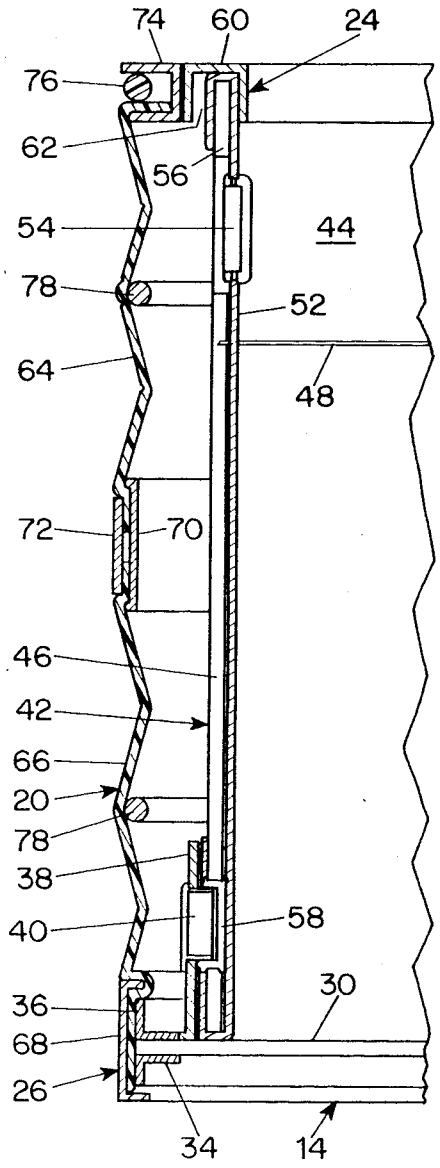

FIGS. 4 and 5 are typical of the construction of all of the perimeter walls 16, 18, 20 and 22 of the body. A rigid top peripheral frame 24 and a rigid bottom peripheral frame 26 extend about the entire perimeter of the body. The frames 24 and 26 are preferably built up from extruded aluminum sections bent at the corners and butt-jointed along one wall. The use of built-up frames 24 and 26 facilitates bending the members at the corners and allows the body 10 to be finally assembled from sub-assemblies.

The top wall or lid 12 and the bottom wall 14 of the body 10 are composed of rigid panel members 28 and 30, respectively. The panel members may be of plywood, fibreboard, metal, laminated structures or, as in the embodiment, extruded polymeric material comprising outer skin sheets and a series of transverse ribs. The panel 28 of the lid is framed by an extruded aluminum member 32 bent and butt-jointed to match the perimeter of the panel and bonded to it. A pair of angle members 34 and 36 are similarly formed and bonded to the bottom panel member 30. Brackets 38 fitted with the male elements 40 of a snap fastener are joined to the centers of the left and right end portions of the angle members 36. The lid, of course, is one sub-assembly cf the luggage item. The bottom panel member 30, angle members 34 and 36 and brackets 38 constitute a second sub-assembly.

Foldable inner wall panel members 42 define the interior perimeter walls of the luggage item. Each of the walls 16, 18, 20 and 22 comprises an upper panel portion and a lower panel portion joined to each other at a fold line parallel to the bottom wall 14. In the embodiment the wall 20, which is typical of all of the perimeter internal walls, comprises an upper panel portion 44 and a lower panel portion 46 joined at a fold line 48. Each portion has an individual rigid sheet member, which may be of plywood, fibreboard, metal or plastic. The rigid sheet members are bonded to a flexible plastic film or fabric web that is co-extensive with all of the rigid sheet members of the foldable, rigid internal walls of the luggage item and joins the sheet members into a subassembly. The web provides a "living hinge" at the fold lines 48 and at the corner junctures.

Figure 3:
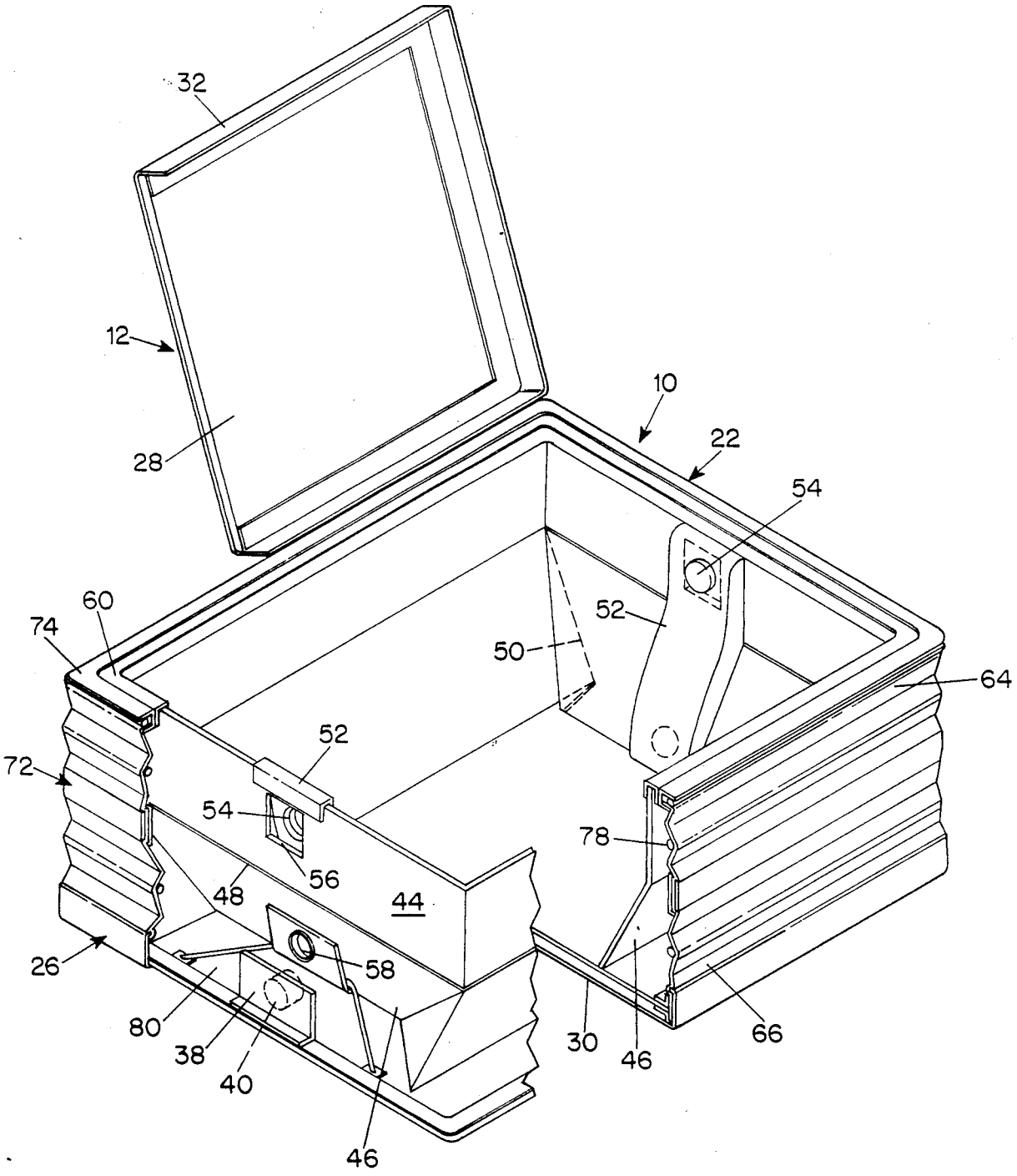
FIG. 3 is a pictorial view of the embodiment in a partially expanded condition, portions being shown broken out or broken away.

The lower rigid panel portions 46 of the front and back walls 16 and 18 are rectangular; the lower rigid panel portions 46 of the end walls (e.g., 46, FIGS. 4 and 5) are trapezoidal, having their ends at 45° to their top and bottom edges. When the wall panels are folded (FIG. 1), a triangular segment of the web at each corner folds under the lower rigid panel member of the respective end wall (see the dotted lines 50 in FIG. 3). When the panel members are unfolded (FIG. 2), the triangular segments bridge the gaps between the rigid sheet members at the lower end corners of the lower rigid sheet members.

A fabric strap 52 (FIGS. 3, 4 and 5) extends vertically along the inside of the rigid panel member of each end wall, is folded over the upper and lower edges, and is fastened to the back surfaces of the rigid panel members (e.g. 44 and 46); the inside part of each strap 52 is not attached to the panel member, so it can be grasped and pulled inwardly. A female snap fastener element 54 is attached to each strap 52 near the upper end and faces out through a hole 56 in the upper rigid panel member 44. Another female snap fastener element 58 is attached to the lower rigid panel member 46 in a position to snap onto the male element 40. When the lower snap connection is done up, the lower panel portions 46 are held in the extended position, thus defining the larger interior volume of the luggage item.

An upper peripheral channel member 60 is bonded to the upper edges of the upper rigid panel members (e.g. 44) of the rigid foldable internal walls. A space 62 is left between the external channel leg and the panel. In the folded condition of the rigid foldable panel members, the upper edges of the brackets 38 extend into the space 62, and the upper snap connection (between male element 40 and female element 54) is made to establish and maintain the smaller volume of the luggage item (FIG. 1).

The external surfaces of the peripheral walls 16, 18, 20 and 22 comprise an upper member 64 and a lower member 66 of pleated sheet material, which may be of fabric, leather or polymeric film. Preferably, each member 64 and 66 is a band of flexible polyvinyl chloride heat-formed to define living hinges at the pleats, corner folds, and upper and lower edge forms suited to making junctures with the frame members. Each member 64 and 66 extends continuously along the front, the two ends and the back walls and has its ends suitably joined at the back wall. The lower edge portion of the lower pleated member 66 is bonded to the angle members 34 and 36 and is further held in place and is protected by an extruded aluminum frame member 68. An intermediate frame member 70 is bonded to the pleated members 64 and 66, which are further held in place by an aluminum band 72. A channel member 74 is bonded (or otherwise joined) to the channel member 60 at the upper edges of the peripheral walls and receives the upper edge portion of the upper pleated member 64 and a plastic or metal retainer rod 76. Aluminum rods 78 bonded to the center pleats of the pleated members 64 and 66 reinforce and define the shapes of the pleated external walls.

In addition to reinforcing and defining the external pleated walls of the luggage item, the intermediate frame members 70 and 72 provide a fastening point for a carrying handle (not shown) at the center of the front wall. Suitable latches (not shown) are, of course, provided between the front of the lid frame 32 and the upper frame 24 of the body 10, as is conventional.

The pleated end walls, the rods 78 and the intermediate frames 70, 72 impart considerable stiffness to the pleated peripheral walls in the direction of the load when the luggage item is carried by the handle. The back foldable rigid wall is coextensive with the load being carried in the item in both the expanded and contracted configurations.

To change the item from the expanded (FIG. 2) to the contracted configuration, the user grasps the straps 52 and pulls them inwardly to unsnap the lower snap connection. The body can easily be collapsed by pushing down on the upper edges of the end walls. The upper female fasteners 54 are then pressed outwardly to snap them into the male fasteners 40. The straps are grasped and pulled in to release the upper fasteners. Elastic bands 80 (FIG. 3) connected between the lower rigid panel members of the end walls and the lower frames 26 bias the item toward the expanded configuration.

The external surfaces of the lid and the bottom wall of the body can be covered with fabric, leather or polyvinyl chloride sheets. Buttons can be attached to the upper and lower frames on the outside of the back wall to provide feet when the item is placed upright on a floor.

I claim:

1. An item of expandable luggage comprising a rigid top peripheral frame, a rigid bottom peripheral frame, a rigid intermediate peripheral frame, each frame having side and end portions fully bounding a planar, substantially rectangular opening and all such openings being of the same size, a rigid rectangular top wall member affixed to the top frame, a rigid rectangular bottom wall member affixed to the bottom frame, an upper peripheral wall member of a pleated sheet material affixed to and extending coextensively with the top and intermediate frames, a lower peripheral wall member of pleated sheet material affixed to and extending coextensively with the bottom and intermediate frames, the pleats of the peripheral wall members extending peripherally so that the peripheral wall members can be selectively expanded and collapsed to define a larger volume and a smaller volume of the luggage item, and foldable rigid side and end wall members, each having an upper portion rigidly affixed to the top frame along a corresponding side or end portion thereof inwardly of the pleated wall members and disposed orthogonally to the plane of the opening defined by the top frame and a lower portion foldable along a fold line parallel to the top and bottom frames, the fold lines of all of the rigid said and end wall members being equidistant from the top of same to further define when unfolded the large volume and when folded the smaller volume.

2. An item of expandable luggage according to claim 1 and further comprising releasable fastener means associated with the foldable rigid end wall members and the end portions of the bottom frame to retain the item of luggage selectively in the smaller volume and larger volume configurations.

3. An item of expandable luggage according to claim 2 wherein the fastener means includes snap fasteners, each having a first element and two second elements engageable with the first elements, the first element being affixed to the end portion of the bottom frame, one second element being affixed to the upper portion of a corresponding foldable end wall member and the other second element being affixed to the lower portion of a corresponding foldable end wall member.

4. An item of expandable luggage according to claim 1, wherein the top wall member is hinged to one side portion of the top peripheral frame so that it can be displaced for access to the enclosed volume.

* * * * *